United States Patent [19]

Demarest

[11] Patent Number: 5,027,982

[45] Date of Patent: Jul. 2, 1991

[54] AEROSOL ACTUATOR AND OVERCAP ASSEMBLY

[75] Inventor: Scott W. Demarest, Caledonia, Wis.

[73] Assignee: S. C. Johnson & Son, Inc., Racine, Wis.

[21] Appl. No.: 502,074

[22] Filed: Mar. 29, 1990

[51] Int. Cl.[5] ..... B65D 83/14

[52] U.S. Cl. ..... 222/182; 222/402.11; 222/402.13

[58] Field of Search ..... 222/153, 182, 402.11, 222/402.12, 402.13, 402.15, 402.21, 402.23, 402.24, 384

[56] References Cited

U.S. PATENT DOCUMENTS

| | | | |
|---|---|---|---|
| 2,887,273 | 5/1959 | Anderson et al. | 222/402.11 X |
| 3,006,510 | 10/1961 | Sagarin | 222/182 |
| 3,263,867 | 8/1966 | Lehmann | 222/182 |
| 3,263,868 | 8/1966 | Sagarin | 222/402.13 X |
| 3,474,939 | 10/1969 | O'Donnell et al. | 222/402.12 X |
| 3,484,023 | 12/1969 | Meshberg | 222/402.11 |
| 3,729,119 | 4/1973 | Sette et al. | 222/182 X |
| 3,754,689 | 8/1973 | Blank | 222/402.11 |
| 3,884,393 | 5/1975 | Wassilieff | 222/402.11 X |
| 3,918,615 | 11/1975 | Morane | 222/402.13 |
| 4,187,963 | 2/1980 | Mascia | 222/402.13 |
| 4,315,576 | 2/1982 | Murphy et al. | 220/282 |
| 4,442,955 | 4/1984 | Bush | 222/402.13 X |
| 4,482,082 | 11/1984 | Goncalves | 222/182 |
| 4,542,837 | 9/1985 | Rayner | 222/402.11 |
| 4,620,646 | 11/1986 | Crapser | 222/182 X |
| 4,776,491 | 10/1988 | Nitta | 222/402.11 X |

FOREIGN PATENT DOCUMENTS

| | | | |
|---|---|---|---|
| 2214135 | 10/1973 | Fed. Rep. of Germany | 222/402.11 |
| 913113 | 12/1962 | United Kingdom | 222/402.13 |

*Primary Examiner*—Kevin P. Shaver

[57] ABSTRACT

A two-part rotatably mounted actuator and overcap assembly for an aerosol container. The overcap has two openings which, in one position, expose the nozzle and actuator button of the actuator. When the overcap is rotated relative to the actuator, the nozzle and actuator button are both covered over by the overcap. A cooperating stop and groove to limit the rotation of the overcap and actuator, and the two portions are made visibly distinct to allow user to see at a glance whether the assembly is in open or closed position.

8 Claims, 2 Drawing Sheets

AEROSOL ACTUATOR AND OVERCAP ASSEMBLY

TECHNICAL FIELD

This device relates to the field of aerosol dispensers and more particularly to a two-part actuator and overcap combination for an aerosol container that allows the actuator and nozzle means to be covered over when the aerosol is not being used.

BACKGROUND ART

Pressurized containers for dispensing aerosols are usually made with a centrally located axially extended valve stem which must be either depressed or tilted to release the contents of the container. Thus, an actuator assembly with a triggering means to activate the valve stem and, usually, some variety of nozzle to direct the emitted aerosol spray must be used with such cans. For a variety of reasons it has been found advantageous to place an overcap assembly (which may be either integrally formed with the actuator assembly or may be a separate structure) over the actuator assembly to prevent inadvertent or undesired release of the aerosol. Reasons for wishing to have some means to prevent accidental or inadvertent release of the contents of a pressurized container range from safety, especially that of children who might easily push a completely exposed trigger to the simple desire to avoid the potential unpleasantness or loss of product that can result from inadvertent release of a product into the wrong place or wrong direction.

Many types of actuators with overcaps are known. The simplest type of overcap is a cap-like structure designed to fit over the actuator and onto the aerosol container itself. Such a cap is simply pressure lifted off the container for use. The major problem with this type of overcap is the simple fact that it is a separate piece and may not be replaced after use or even be lost.

One example of the detachable overcap is disclosed in U.S. Pat. No. 4,315,576, to Murphy et al., Child Resistant Closure Cap Apparatus Employing Fulcrum Action.

"Overcaps" that partially block access to the actuator trigger are also known.

An example of a fixed overcap having a central opening on its upper surface for allowing access to the depress button which actuates the valve of the pressurized container is given in U.S. Pat. No. 3,006,510, to Sagarin, Aerosol Cap Construction.

An overcap assembly for a pressurized container having a radially slidable valve guard which must be moved toward the center of the can before it can be depressed to actuate the valve of the container is disclosed in U.S. Pat. No. 4,442,955 to Bush, Child-Resistant and Tamper Indicating Overcap.

Overcaps that are mounted so that they can be rotated relative to the actuator assembly for a pressurized container are also known.

An overcap designed to fit rotatably over an actuator-nozzle assembly and having an opening, which aligns with the nozzle of the assembly and an actuator tab which, when depressed, pushes against an inner actuator member to activate the can is disclosed by U.S. Pat. No. 3,754,689 to Blank, Safety Overcap for Aerosol Containers.

U.S. Pat. No. 3,729,119 to Sette et al., Childproof Overcap with Horizontal Spray discloses an overcap which rotatably mounts on an inner shell which itself fits over an actuator button. The overcap has two openings: one for the spray exit and a second for finger access to the actuator button. The overcap must be turned, depressed, and turned again to bring the openings from a position blocking both the spray exit and the button access to the open position.

SUMMARY DISCLOSURE OF THE INVENTION

The present invention offers a two-part actuator and overcap assembly for a pressurized aerosol container that has both functional and, especially when the visual appearances of the actuator and overcaps and the container body are appropriately coordinated, aesthetic appeal.

The actuator of the assembly fits over the top of a pressurized container of the type having a necked-in formation of the top of the container with a central valve stem which can be actuated either by depressing or tilting the valve stem.

The actuator has an actuator trigger or button and a channel formed into the structure of the actuator. The channel has at one end a valve socket designed to fit over the valve stem of the pressurized container and at its other end a nozzle opening which is designed to control emission of the aerosol spray. A separate nozzle insert may be inserted into the nozzle opening to improve the flow control. The channel is angled so that the valve socket and the nozzle are oriented at approximately 90° to each other, so that the pressurized product emerging from the top of the container is redirected to issue from the nozzle at an approximate right angle to the axis of the container.

The overcap, which is rotatably fitted over the actuator, is in the general form of a cylinder open at one end and closed at the other. The open end is fitted over the actuator of the assembly. Toward the closed end of the overcap are two openings, so located that, in one position of the overcap relative to the actuator, the actuator button and the spray nozzle are exposed.

When the overcap is rotated relative to the actuator, either in a clockwise or counter clockwise direction, the nozzle and the actuator button are both simultaneously covered over. A rotation limiting mechanism limits the rotation of the overcap to a range of approximately 90°.

There are primarily two functional advantages of this assembly: safety and convenience. The safety advantages arise from the fact that the actuator button and nozzle can be closed over to prevent accidental or undesired release of the aerosol. The design of the overcap and actuator is such that rotation of the overcap relative to the actuator simultaneously covers over both the actuator button and the nozzle and thus prevent any undesired release of the aerosol within the overcap.

The convenience of the design arises from the same source—the fact that the aerosol can be totally closed over and thus protected from inadvertent discharge. Thus, an aerosol container with the actuator overcap assembly of the present invention could, for example, be thrown into a packed suitcase with little or no danger of finding that the contents of the suitcase had shifted during transportation, accidentally activated the aerosol, and hair spray was sprayed on a silk blouse.

A further factor combines both the safety and convenience factors: the overcap and actuators, although made separately, are rotatably but permanently fitted together. What this means is very simple yet very important: the overcap is always available for protection since it cannot get lost.

The aesthetic appeal of the actuator, overcap, and container assembly arises from the streamlined appearance of the assembly. Such an assembly can be made to have greater visual impact if the overcap and the actuator are formed of materials that are visually distinct, in either value or hue. This latter option is not only an aesthetic factor for it has a very practical effect. The user can tell at a glance whether the aerosol assembly is in the open and operable position or the closed and inoperable position.

A further advantage of the present invention is its simplicity. The simplicity of operation of the device also makes consumer use simple and straightforward, increasing the probability that the user will actually reclose the assembly after use especially since the closed and open positions are easily visually apparent. While devices with more complicated locking systems exist and can offer safety features, such safety features are rendered non-existent if the locking of the assembly requires such a complicated series of motions for opening and closing that the user becomes inclined to leave the assembly open at all times.

Yet a further advantage of this simplicity is the ease and economy of manufacture of the assembly.

BEST MODE FOR CARRYING OUT THE INVENTION

Figure 1:
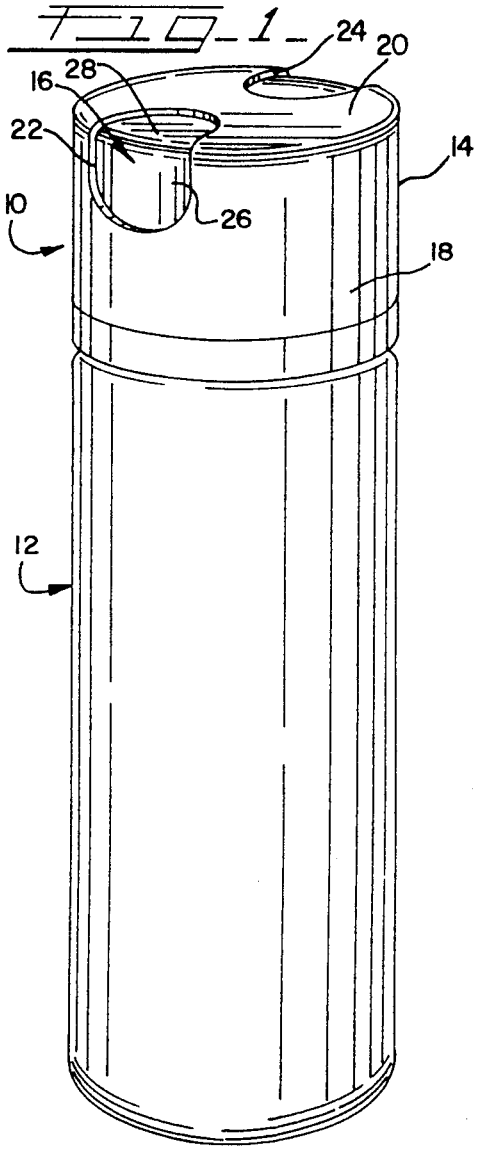
FIG. 1 is a perspective view of the actuator and overcap assembly in the closed position and fitted onto a pressurized container.

FIG. 1 shows actuator and overcap assembly 10 placed upon a pressurized container 12. Actuator and overcap assembly 10 has two portions: an outer overcap 14 and an inner actuator 16. Outer overcap 14 has overcap sidewall portion 18 and overcap top portion 20. Outer overcap 14 has two similarly shaped openings located on opposite sides of outer overcap 14, both of which are located so that approximately half of the opening lies on overcap top portion 20 and approximately half of the opening lies on sidewall portion 18. The shapes of the openings in the overcap may be varied as desired for aesthetic appearance. These openings are, respectively, overcap nozzle exposing opening 22 and overcap actuator button exposing opening 24. Inner actuator 16 also has actuator sidewall portion 26 and actuator top portion 28.

In FIG. 1, overcap openings 22 and 24 are so positioned that actuator sidewall portion 26 and actuator top portion 28 are visible through overcap openings 22 and 24.

Figure 2:
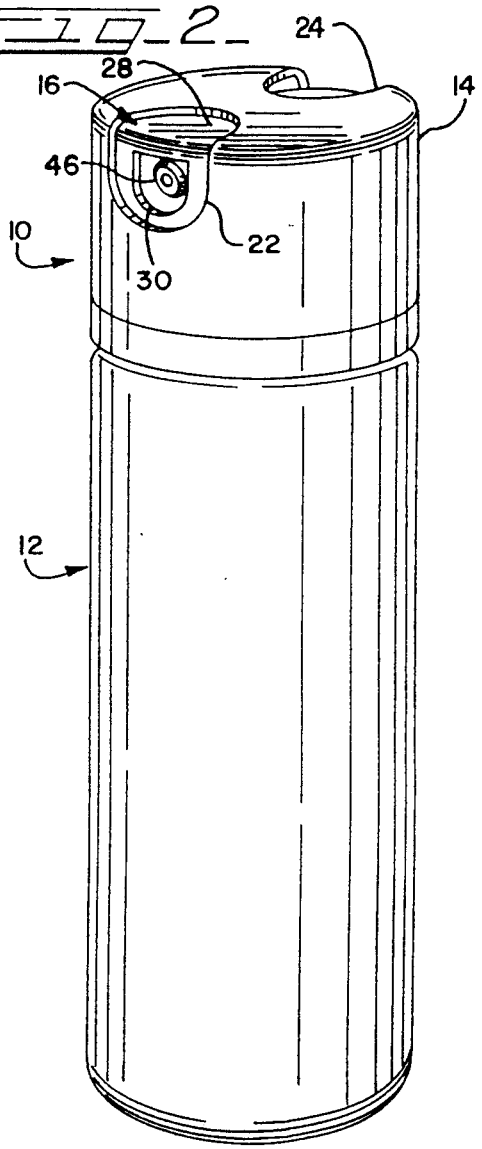
FIG. 2 is a perspective view of the actuator and overcap assembly in the open position and fitted onto a pressurized container.

FIG. 2 shows the same elements of actuator and overcap assembly 10 as FIG. 1, but outer overcap 14 has been rotated relative to inner actuator 16 in a counterclockwise direction approximately 90°. This rotation direction is indicated by the directional arrows on FIG. 3, which shows a top plan view of actuator and overcap assembly in the closed position shown in perspective in FIG. 1.

Figure 4:
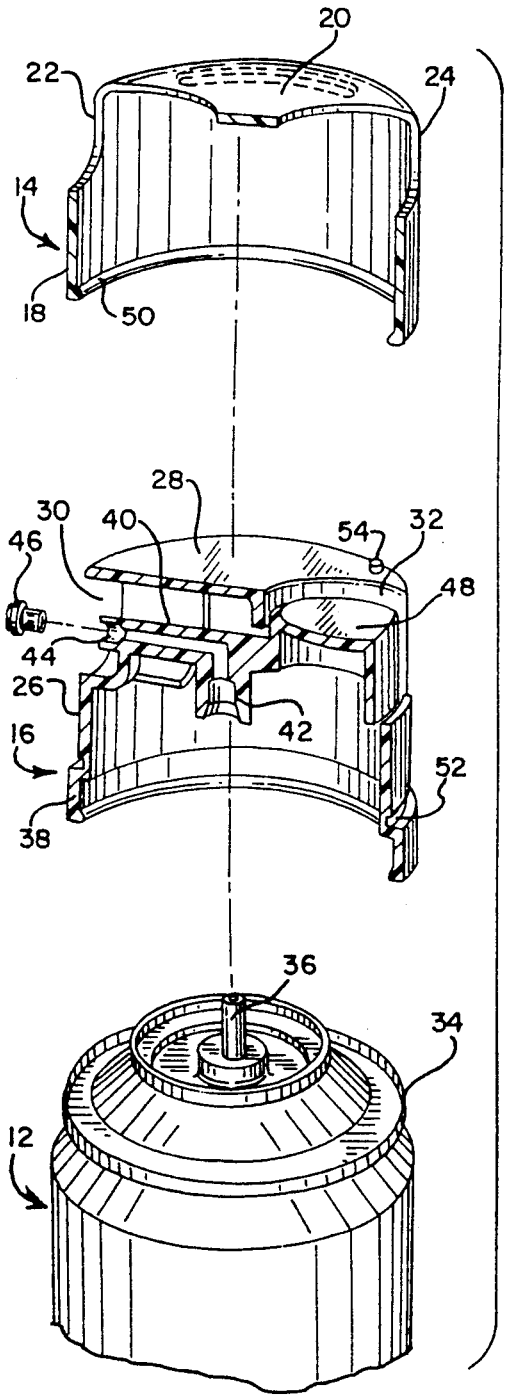
FIG. 4 is an exploded partially in perspective and partially in sectional view of the actuator and overcap assembly, taken along line 5—5 of FIG. 3, positioned above a partial perspective view of a pressurized container.
Figure 5:
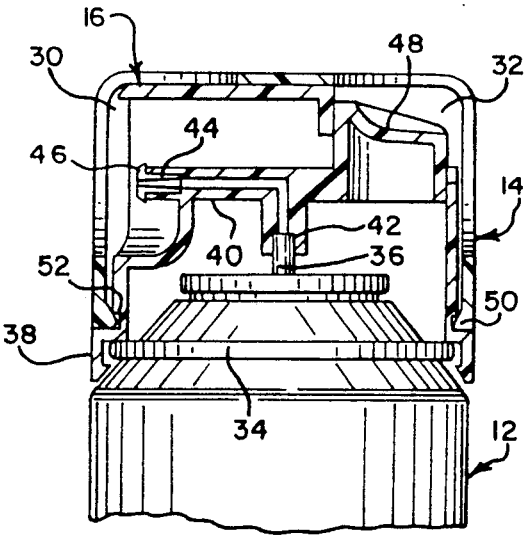
FIG. 5 is a sectional view of the actuator and overcap assembly, taken along line 5—5 of FIG. 3, showing the assembly fitted onto a pressurized container which is shown in a partial side plan view.

This rotation of outer overcap 14 relative to inner actuator 16 has brought overcap nozzle exposing opening 22 to a position over actuator nozzle opening 30 of inner actuator 16, and overcap actuator button exposing opening 24 to a position over actuator button opening 32 of inner actuator 16 (visible in FIGS. 4 and 5).

FIG. 4 is a partially in section, partially in perspective exploded view of outer overcap 14 and inner actuator 16 aligned above a partial perspective view of pressurized container 12. The section is taken along line 5—5 of FIG. 3.

Pressurized container 12 has a necked-in upper end with encircling band 34 and central actuation valve stem 36. Inner actuator 16 has formed into its lower circumference encircling rim structure 3 designed to be pressure fit over encircling band 34.

Inner actuator 16 has central channel portion 40. Central channel portion 40 has at one end valve socket 42 designed to fit over central actuation valve stem 36 of pressurized container 12 and, at its other end, channel nozzle opening 44. Channel nozzle opening 44 is designed to accept separately formed nozzle structure 46, which is designed to give the desired directional and flow characteristics to the emitted aerosol spray. The presence of nozzle structure 46, which may be either an insert or be placed over channel nozzle opening 44, is, however, optional.

Central channel portion 40 is angled so that valve socket 42 and channel nozzle opening 44 are axially oriented approximately 90° from each other. This orientation allows the aerosol spray which would be otherwise released from the pressurized container along the axis of the container to be redirected and emerge at a right angle to the container.

Connected to and integrally formed with central channel portion 40 near valve socket 42 is depressible actuator button 48. Outer overcap 14 is rotatably fitted over and onto inner actuator 16. Both the rotation and the fit are accomplished by the existence of an inner lip 50 encircling the inner edge of the open end of the outer overcap 14. Inner lip 50 fits into circumferential groove 52 which is located around the circumference of and just above encircling rim structure 38 of inner actuator 16. Once inner lip 50 is fitted into circumferential groove 52, outer overcap 14 will rotate relative to inner actuator 16 but the two portions are affixed together.

FIG. 5, a side sectional view of the actuator and overcap assembly, showing outer overcap 14 and inner actuator 16 fitted together and fitted onto pressurized container 12.

When outer overcap 14 and inner actuator 16 are pressure fitted together, the degree of rotation of outer overcap 14 relative to inner actuator 16 is limited by a rotation limiting mechanism, which may be any one of the methods known for providing a motion stop or limit.

Figure 3:
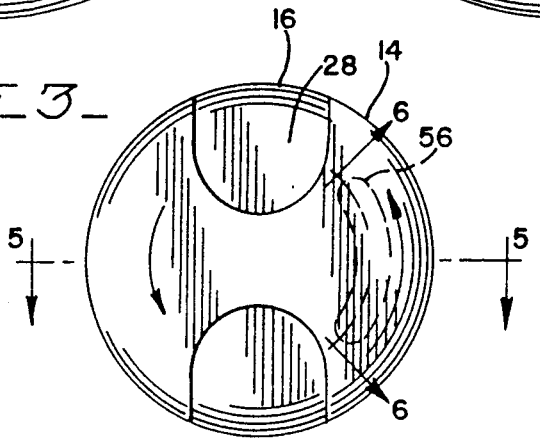
FIG. 3 is a top plan view of the actuator and overcap assembly in the closed position showing the direction of rotation of the overcap to move the overcap to the open position.
Figure 6:
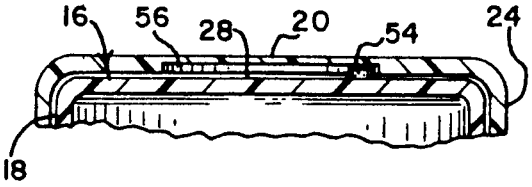
FIG. 6 is a side sectional view of a portion of the actuator and overcap assembly, taken along line 6—6 of FIG. 3, showing the motion groove and stop extension motion limiting means.

As is shown in FIG. 6, which shows a cross-section through outer overcap 14 taken along the center line of overcap motion groove 56 shown as line 6—6 on FIG. 3, in the preferred embodiment of the present invention, this rotation limiting means is positive stop extension 54, located on the outer surface of actuator top portion 28. In this figure, inner actuator 16 and outer overcap 14 are shown fitted together so that stop extension 54 projects up into overcap motion groove 56.

Stop extension 54 is located so that it fits into and, when outer overcap 14 and inner actuator 16 are fitted together and rotated relative to each other, moves along and within overcap motion groove 56 which is located on the underside of overcap top portion 20, and indicated by dotted lines in FIG. 3. Overcap motion groove 56 is spaced in from overcap sidewall portion 18 and has a length lying along approximately one-fourth the circumference of the top of outer overcap 14. When the outer overcap 14 is rotated relative to inner actuator 16 and stop extension 54 moves within motion groove, this limits the degree of relative rotation of the two portions to approximately 90°. Stop extension 54 and overcap motion groove 56 also serve to assure correct relative placement and continued position of outer overcap 14 and inner actuator 16.

Actuator and overcap assembly 10 is preferably made from injection molded plastic. Outer overcap 14 and inner actuator 16 are preferably made from plastics that are visually distinct, either in color or in hue, not only for visual impact of the assembly, but so that the user can tell at a glance whether the assembly is in the open and use-ready position or the closed and protected position.

INDUSTRIAL APPLICABILITY

Other modifications of the aerosol actuator and overcap assembly of the present invention will become apparent to those skilled in the art from an examination of the above patent Specification and drawings. Therefore, other variations of the present invention may be made which fall within the scope of the following claims even though such variations were not specifically discussed above.

Aerosol actuator overcap assemblies according to the present invention may be used in combination with any necked-in pressurized container having a central valve stem, whether the valve is actuated by being tilted or by being depressed. Many types of products are offered in such containers: hair sprays, insecticides, air fresheners, etc. This assembly would be suitable for any aerosol product in such a container.

What I claim is:

1. An actuator and overcap assembly for a pressurized container with a central actuation valve stem comprising:

an actuator having a generally cylindrically shaped outer housing with a closed top end, and an open bottom end, and having integrally formed with the actuator housing 1) a central channel structure forming a central channel having two open ends, a first open end being designed to fit over the valve stem of the pressurized container and a second open end forming a nozzle opening and 2) a depressible actuator button, the actuator button being connected to the central channel structure near its first end, and rotatably mounted upon and over the actuator, an overcap having a generally cylindrically shaped outer housing with a closed top end and an open bottom end the open end having formed around the inside of its circumference thereof means for rotatably mounting the overcap over and upon the actuator, the actuator having formed around the outside of the circumference of the open end thereof receiving means for cooperating with the means for rotatably mounting said overcap, the overcap having two openings through its outer housing, the first opening through the housing of the overcap being so located that when the overcap is mounted upon the actuator the first opening of the overcap is located so as to be in front of and expose the nozzle opening of the actuator, and the second opening of the overcap is located so as to be over and expose the actuator button of the actuator, and, when the overcap is rotated relative to the actuator, the nozzle opening and actuator button exposed by the first and second openings in the overcap are simultaneously covered over as the first and second openings in the overcap are rotated away from their positions over the nozzle opening and channel of the actuator.

2. An assembly according to claim 1 wherein the actuator and the overcap have cooperating means for limiting the circumferential rotation of the overcap relative to the actuator.

3. An assembly according to claim 1 wherein the central channel structure of the actuator is designed so that, when the actuator and overcap assembly is placed over and onto a pressurized container having a central valve stem, and pressure is applied to that actuator button, thus activating valve stem of the pressurized container, the central contents of the container exit the valve stem, pass through the central channel of the central channel structure to the nozzle of the channel, and exit the nozzle in a direction approximately 90° from the axis of the container.

4. An assembly according to claim 1 wherein the actuator and the overcap are formed from materials that are visually distinct.

5. An assembly according to claim 1 wherein the actuator and the overcap are formed from injection-molded plastic.

6. An assembly according to claim 1 wherein the nozzle of the central channel of the actuator further comprises a separate nozzle structure which fits within the nozzle opening of the channel.

7. An assembly according to claim 1 wherein the actuator and the overcap have mutually cooperating rotation limiting means which, when the overcap is rotatably mounted onto the actuator, limits the degree of relative rotation of the overcap and the actuator.

8. An assembly according to claim 1 wherein the rotation limiting means comprises a stop extension on the upper surface of the top end of the actuator and a motion groove located in the inside of the upper surface of the overcap and spaced in from the sidewall portion of the overcap lying along approximately one-quarter of the circumference of the overcap top surface and of a width and depth to allow, when the overcap and the actuator are fitted together, the stop button travels inside and along the groove.

* * * * *